US005794737A

United States Patent [19]

Zhong et al.

[11] Patent Number: 5,794,737

[45] Date of Patent: Aug. 18, 1998

[54] ANTISLIP TRACTION MACHINE

[76] Inventors: Jianyuan Zhong; Lei Zhong, both of 303 Room, No.58, XiBei Xin Cun, Wu Xi, 214062, Jiang Su Province, China

[21] Appl. No.: 793,766

[22] PCT Filed: Aug. 23, 1994

[86] PCT No.: PCT/CN94/00064

§ 371 Date: Feb. 19, 1997

§ 102(e) Date: Feb. 19, 1997

[87] PCT Pub. No.: WO96/06035

PCT Pub. Date: Feb. 29, 1996

[51] Int. Cl.[6] ..... B66B 11/08

[52] U.S. Cl. ..... 187/266; 187/350

[58] Field of Search ..... 187/266, 254, 187/256, 264, 251, 350

[56] References Cited

FOREIGN PATENT DOCUMENTS

| | | |
|---|---|---|
| 86-100436 | 9/1986 | China . |
| 86100436 A | 9/1986 | China . |
| 2064355 U | 10/1990 | China . |
| 1086788 A | 5/1994 | China . |
| 1094010 A | 10/1994 | China . |
| 0 545 369 | 6/1993 | European Pat. Off. . |
| 652074 | 3/1979 | U.S.S.R. . |

*Primary Examiner*—Kenneth Noland

*Attorney, Agent, or Firm*—Merchant, Gould, Smith, Edell, Welter & Schmidt

[57] ABSTRACT

An elevator drive machine includes a speed reduction unit, a driving sheave, and the first and the second driven sheaves formed over the driving sheave and arranged a triangle with the driving sheave. Each of the sheave has ratchet on its periphery, a pawl mechanism is mounted near the sheave. A speed limiter which includes a centrifugal speed limiter engaging with the gear of the first driven sheave and a three-branch lever, is provided on the side of driving sheave and the first driven sheave. When the dropping speed of the cab overruns the given speed, the three-branch lever moves so as to make the ratchet engage with the pawl, thus braking the driving sheave and the first driven sheave, quickly increasing the friction force of driving rope and immediately stopping the cab. It can prevent the rope from sliding on the sheaves, and has advantages of compact construction and low cost.

5 Claims, 2 Drawing Sheets

ANTISLIP TRACTION MACHINE

TECHNICAL FIELD

The present invention relates to a traction driving device for hoisting machine and electric elevator, more specifically relates to an antislip traction machine for driving device of hoisting machine and electric elevator during driving to prevent traction rope from slipping and cage from dropping.

TECHNICAL BACKGROUND

The superiority of frictional drive over forced drive has been generally acknowledged and the frictional drive has replaced the forced drive in an all round way. However, an existing frictional driving device for use in electric elevators has rather high requirement to environmental condition, for instance, it must have s speed limiter—safety clamp system and guideways to meet demand for the braking of this system, the pit tunnel must be closed, machine room must be set up, etc. These requirements confine its use within the indoor pit tunnels. In construction work where a machine room is difficult to be set up, the lifting elevators of gear and rack transmission type, hydraulic type and linear electric motor actuation type will undertake the vertical transportation of persons and materials. While the low-cost, easy-to-handle wire rope transmission type lifting machines can only carry materials.

The frictional drive has made the possibility of rope breakage to a negligible degree. The statistical result derived from 200,000 electric elevators during 15 years of service in Germany was: one traction rope breakage occurred only to two electric elevators. According to these basic data together with an assumption that each elevator makes 20 times of lifting daily, a probability calculation shows that the period or cycle for the four traction ropes of an elevator to break in one lifting (resulting in a cage dropping) is $1.57\times10^{37}$ years.

The function of a speed limiter—safety clamp system is to prevent cage from dropping. The dropping accident almost never happens with modern electric elevators, however not all of this is to be attributed to the action of this system. Tests of preventing cage from dropping with rope breakage conducted by a transportation organization in London to the speed limiter—safety clamp system approved by the European Community Standard Organization showed that in 33 tests, the results of 31 tests were positive and 2 negative. The rate of success was 94%. It suggested the main reason for occurring no cage dropping was the rational use of wire rope in frictional drive which almost results in no breakage of wire. Of course the braking of speed limiter—safety clamp system under the condition of having counterweight in overspeed slipping is reliable.

The present applicant has noticed the condition of almost no breakage of the above-mentioned wire rope in frictional drive, and adopted the wire rope as safety rope to prevent cage from dropping, while making use of frictional drive principle and ratchet pawl braking mechanism as well as centrifugal speed limiter control mechanism to constitute a kind of dropping prevention system and obtained a Patent (CN86100436), and later on, through combining system with the forced drive several kinds of elevating machines for both person and cargo have been produced by making use of wire rope for lifting and dropping prevention, with cost reduced by one half in comparison with existing elevating machines and with distinct economic effect and social effect. However, all these elevating machines have the drawback of forced drive—a larger possibility of lifting rope breakage.

The structure of the frictional drive device of existing electric elevators is rather loose, it is installed horizontally in a machine room, with the drawback of lack of flexibility and in need of a speed limiter—safety clamp system to prevent cage from dropping. Hence the scope of use is limited. The frictional drive can not be popularized. For instance, presently in Japan, elevators for residence all basically adopt oldfashioned forced drive. The reason is that the current frictional drive device is not applicable and the construction of a machine room on a house top will be harmful to the facade of the building. While the linear drive type residence elevators introduced by the Otis Company for sale in Japan cost over $90,000 are difficult for customers to bear.

The above-mentioned conditions show that, in more than 140 years of history, the elevating machine (electric elevator), in spite of its considerable progress, still has a very large gap in comparison with progress of contemporary automobile and electric appliances, this is closely related to the driving device which is the main component of the electric elevator.

According to the principle formula "$F=F^1\times e^{\alpha\beta}$" and practice of frictional drive together with the implementing effect of the Patent "CN86100436" of the present applicant, it is possible to develop a kind of traction machine which integrates frictional drive with dropping prevention. It is perfect in function, requiring no safety clamp, with large flexibility, and applicable under variety of conditions. Thereby electric elevators of frictional drive type with wire rope transmission are made to step out of concrete pit tunnels and enter into construction sites, residences and other places in need, and to produce a kind of new elevating machine (electric elevator) featuring a wide range of applications, potential popularization, and without resort to the safety clamp.

SUMMARY OF THE INVENTION

The object of the present invention is to provide an antislip traction machine with slipping preventing function in itself.

The technical scheme to realize the present invention is as follows:

Specifically speaking, the antislip traction machine of the present invention comprises a speed reducer case, driving pulley, driven pulleys, traction ropes, characterized in that said driven pulleys have two in number, the first and the second driven pulleys, which are disposed above the driving pulley in a triangular arrangement with respect to the driving pulley, said driving pulley and the two driven pulleys are provided with a ratchet on their rim and by the side of each ratchet is provided each a braking pawl mechanism mounted on the case in match with the ratchet; adjacent to the side of the driving pulley and the first driven pulley is provided a speed limiting mechanism capable of constituting a control to the ratchet through the pawl mechanism and thereby limiting overspeed motion of traction rope; said speed limiting mechanism comprises a centrifugal speed limiter mounted on the case and with a gear fitted on its output shaft in engagement relationship with a gear on the side of said first driven pulley and a triple-fork lever rotatably mounted on the case, a fork tip of an intermediate fork head of said triple-fork lever is in contact with an output end of said centrifugal speed limiter, the rest two fork heads of the triple-fork lever are connected to the pawl mechanisms of the driving pulley and the first driven pulley; said traction rope winds in U shape from the first driven pulley through the driving pulley and then winds through the second driven pulley.

Said pawl mechanism comprises a pawl rotatably mounted on the case and in engagement relationship with the ratchet of each pulley, a poking bar fitted on the pawl side wall and a spring fitted behind the pawl and biasing the pawl towards the ratchet. The rest two forks of said triple-fork lever are attached to said pawl mechanism in contacting connection with the poking bar on the pawl. Said speed reducer is mounted on one side of the case, with a gear on its output shaft in engagement relationship with an internal gear of the driving pulley. In addition, there are provided two small electric generators which are mounted respectively on one side of the driving pulley and the first driven pulley and in engagement relationship with a gear on the lateral face of the driving pulley and the first driven pulley through a gear on their shaft ends.

BRIEF DESCRIPTION OF ACCOMPANYING DRAWINGS

THE PREFERRED EMBODIMENT OF THE PRESENT INVENTION

Figure 1:
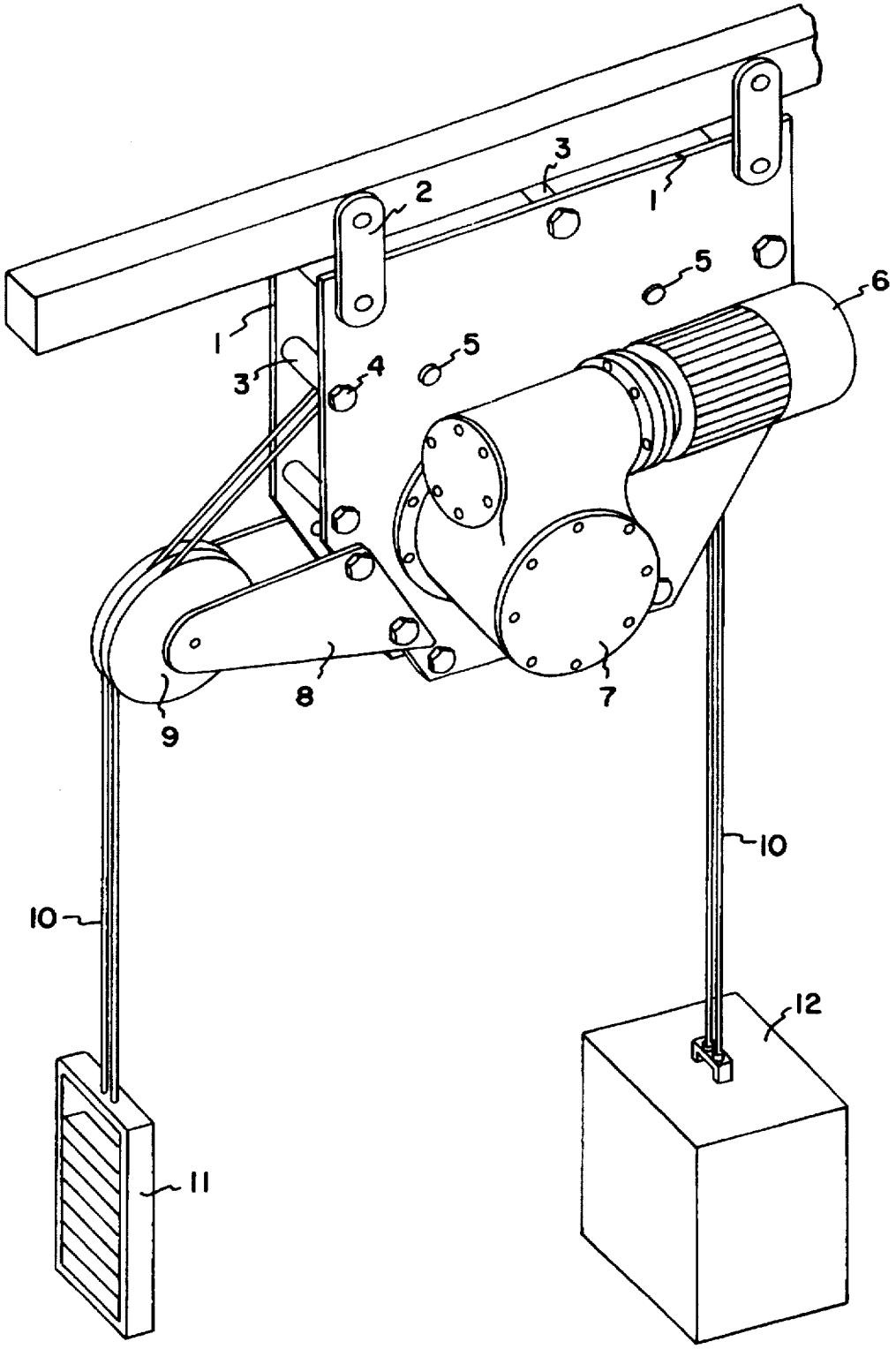
FIG. 1 is a perspective view of the antislip traction machine of the present invention.

FIG. 1 is a perspective view of the antislip traction machine, wherein two steel plates(1), a supporting sleeve(3) and bolts(4) compose a case, two pulley shafts(5) pierce through the case, two connecting lugs hang the traction machine on a beam atop the hoisting machine, a speed reducer(7) driven by an electric motor(6) is mounted on the outer side of the case, a pulley(9) on two dismountable supporting pulley brackets keeps the horizontal distance of both sides of two driving ropes(10) passing through the traction machine equal to the horizontal distance between a cage(12) and a counterweight(11).

Figure 2:
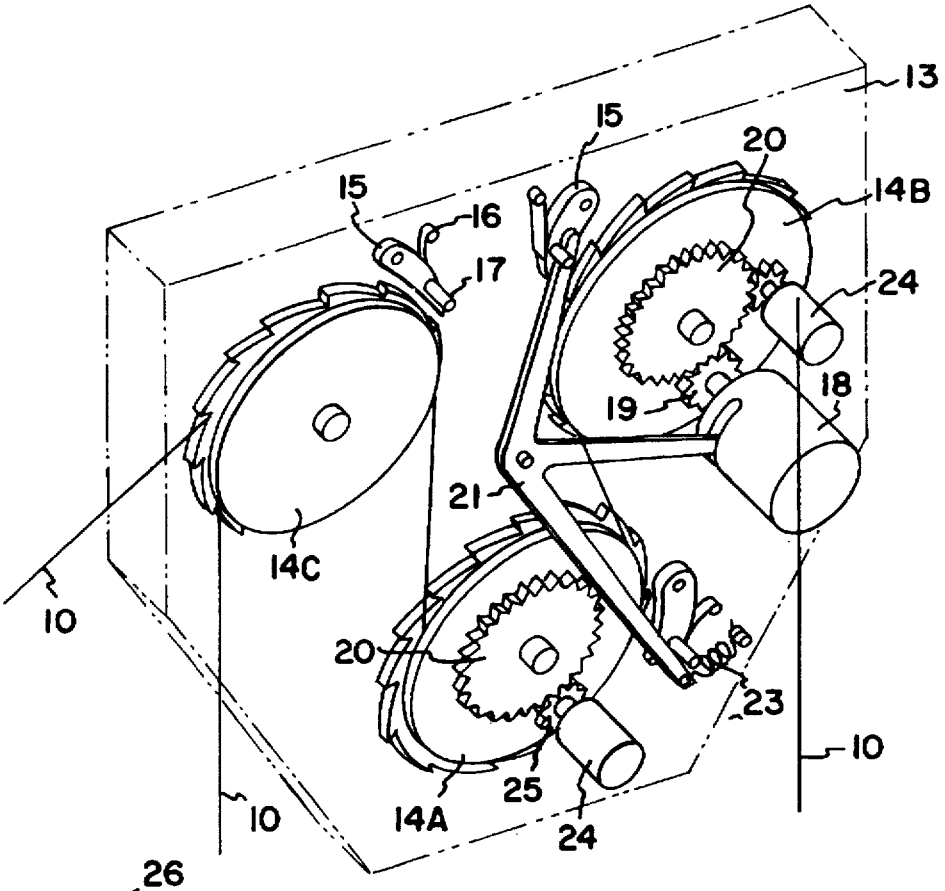
FIG. 2 is a schematic perspective view of the internal structure of the antislip traction machine case of the present invention.

FIG. 2 is a structural diagram of the antislip traction machine, in the case (13) there are three pulleys with ratchet made on the pulley rim wherein (14A) is a driving pulley, (14B,14C) are a first and a second driven pulleys, and braking pawls(15), pawl springs(16) are provided, poking bars(17) on the pawls stretch out from a case hole. A gear(19) fitted on the shaft end of a centrifugal speed limiter(18) mounted on the outer side of the case (steel plate) is in engagement relationship with a gear(20) on the first driven pulley, and a partial radial recess is provided on the periphery of the centrifugal speed limiter, a hole on a transmission triple-fork lever(21) with three forks is defined on a shaft on the outer side of the case, one of the forks inserting into the partial recess on the periphery of the speed limiter makes it connected to the actuating member of the speed limiter(18), the rest two forks contact the poking bars(17) on the pawls, a tension spring(23) connects the lever in tension mode and disconnects the pawl(15) from ratchet through the poking bar(17). When the rotary speed of the first driven pulley(14B) exceeds a specified value, the centrifugal speed limiter will immediately produce an action to poke the lever(21) to overcome the tension of the spring (23) and make the lever(21) out of contact with the poking bar(17), the pawl springs(16) make the pawls(15) engage with ratchets, the driving pulley and the first driven pulley (14A, 14B) are braked, the total frictional force (i.e. the force to brake the cage from slipping) increases abruptly to stop the cage in suspension. The increased value of frictional force can be calculated by the Euler's Formula "$F=F_1\times e^{\alpha f}$", wherein "α" in the power is the wrap angle of traction rope to the pulley. After the driven pulley(14B) being braked, the value of "α" is equal to the sum of wrap angles of the traction rope to the driving pulley(14A) and the first driven pulley(14B), by estimate from configuration, the frictional force here is increased nearly twice as large as the braking force of a single pulley(14A), which ought to be enough, and the second driven pulley(14C) may be allowed to take part in the braking, in case of requiring further increment.

The increment of mass of the counterweight can save energy but will produce reverse slipping, the second driven pulley(14C) is used for reverse braking, the realization of reverse braking can be performed by using a bidirectional centrifugal speed limiter with the addition of a pair of transmission levers. The moving direction of traction rope (10) is indicated by fine solid line.

Two small electric generators(24) are mounted on the outer side of the case, gears(25) on their shaft end stretch into the case from two holes, and engage respectively with gears(20) on the driving pulley(14A) and the first driven pulley(14B). When the speed difference on the pulley groove pitch circle exceeds a specified value, a potential difference will produce and electric current will pass throng an electromagnetic mechanism to cut off the power supply to stop the machine.

Figure 3:
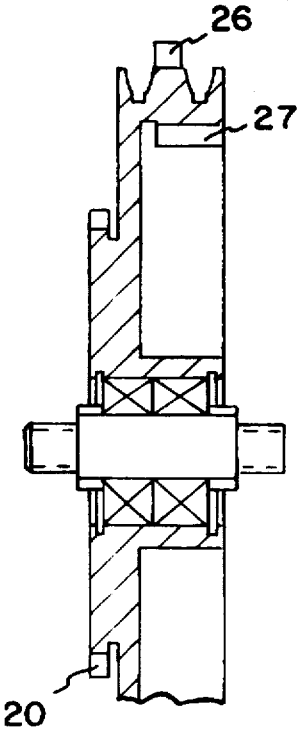
FIG. 3 is a sectional view of the driving pulley in FIG. 2.

FIG. 3 is a sectional view of the driving pulley(14A), on the rim is a ratchet(26), on both sides of it is a pair of pulley grooves with a spur gear(20) on the left side and an internal gear ring(27) is made on the right side.

In a preferred design, in order to prevent traction rope(10) from tension inadequacy caused by jamming of counterweight and the like to produce the condition of idling rope abrasion, two electric generators(24) are mounted on the traction machine which are driven respectively by the driving pulley and the first driven pulley and are connected through lead wire to an electromagnetic deenergizing mechanism. During normal frictional drive running, i.e., the traction rope(10) in pulley groove of the driving pulley(14A) without slipping, the generators are regulated to the currentless condition, and when slipping occurs, there will be current through the electromagnetic mechanism to cut off power supply to stop the machine. It is also possible to allow the driving pulley(14A) and the first driven pulley(14B) to drive respectively two shafts of a differentiating mechanism which will deliver an action to cut off power supply when the rotary speed differential of these two pulleys exceeds a specified value.

As mentioned above, the traction machine has a case, generally three pulleys with ratchet made on their rims, i.e., the driving pulley, the first and the second driven pulleys in a triangular arrangement and in a same plane. The ratchet braking mechanisms are disposed in the gap outside the pulley rims. In order to lessen the impact during the engagement braking of pawl(15) with ratchet (26), buffering material between a movable seat and a fixed seat (not shown) for pawl is provided to avoid damage to pawl. The speed reducer (7) assembled integral with the electric motor is mounted on one side of the case, the output shaft of the speed reducer (7) stretches into the case and the gear on the shaft end and the internal gear ring(27) on the driving pulley constitute an engaging transmission.

The ratchets (26) on the pulley rim and corresponding pawls are divided according to braking direction into two groups wherein one group (the driving pulley and the first driven pulley) is doing braking during the descending of the cage and the other (the second driven pulley) is doing braking during the descending of the counterweight at overspeed, their pawls(15) are respectively subjected to the control of two pairs of transmission triple-fork lever driven by two centrifugal speed limiter (or one bidirectional speed limiter).

The traction rope (10) is wound through the driving pulley and the driven pulleys to form frictional driving to the cage(12). The frictional force for braking the cage is determined by two factors: the groove shape and winding angle α, and the number of pulleys on which ratchet is to be made on the pulley rim is also determined by these two factors.

Said speed limiter(18), transmission triple-fork lever(21), two small electric generators(24) (or speed differentiator) are mounted on one side of the case, the transmission triple-fork lever constitutes an interlocking between an actuator of the speed limiter and the poking bar stretching out from the pawl, the speed limiter is driven by the first driven pulley(14B) or directly driven by the traction rope (10).

On the upper portion of the case are defined two holes or two lugs(2) to enable the case to be hung on the beam at the top of the pit tunnel, or to have a stand made at its lower portion to enable it to be seated on a bottom rack of the machine room.

Beneficial result

Summarizing the above-mentioned, the present invention is: A plurality of driven pulleys are provided around the driving pulley of the frictional traction machine with ratchet made on the pulley rim and braking pawl mechanism provided therewith. A centrifugal speed limiter is mounted on the traction machine to make it be driven by a driven pulley or directly by the traction rope. A transmission triple-fork lever is used between the speed limiter and pawl to form an interlock and to perform control of the speed limiter to the pawl action. The traction rope with its two ends connected respectively to the cage and counterweight winds through said driving pulley and driven pulleys, and the sum of winding angles of the traction rope to pulleys is larger than the winding angle of friction drives of the prior art. When the slipping of traction rope occurs in the driving pulley groove or the driving pulley is out of control so that in cage speed exceeds the specified value, the speed limiter will act, its actuating member will make the pawls engage with ratchets via the transmission lever, the driving pulley and driven pulleys are subjected to braking, the traction rope will acquire frictional force for stopping cage in suspension in the pulley grooves of the braked pulleys.

The beneficial result of the present invention is that the machine can be mounted requiring only a suspension beam provided at the top of the pit tunnel when no machine room is available. In comparison with the counterpart it features a compact structure and less bulkiness; due to an antislip function by itself, no safety clamp is necessary for the driven cage and the requirement to guideway is lowered; it can be widely used in construction sites where conditions for mounting outdoor electric elevators or electric elevators of existing standard are not available. The drawback is that the service life of the traction rope is affected by its forward and reverse winding and bending because the rope has to wind through the driving and driven pulleys, however, tests have proved that it can achieve application indices and gives no unfavorable influence to residence and not frequently used electric elevators.

We claim:

1. An antislip traction machine for elevator elector comprising driving pulley, driven pulleys, traction wire ropes, speed reducer, electric motor and case, characterized in that said electric motor (6), speed reducer (7) are mounted at one side of the case (13), the driving pulley (14A) is in the case (13), the driven pulleys (14B, 14C) are adjacent to the driving pulley, on their rim is a ratchet and pawl braking mechanism (15), a centrifugal speed limiter (18) and ratchet and pawl braking mechanism (15) a transmission lever (21) is used for connection, the traction wire rope (10) with its two ends connecting respectively a cage (12) and a counterweight (11) winds round said driving pulley and driven pulleys, said electric motor (6) on the case (13) rotates the driving pulley (14A) via the speed reducer (7), the traction wire ropes (10) obtain, in the rope grooves on the driving pulley (14A),frictional force for driving the cage (12), when the rotation speed of driven pulley exceed a specified value, the centrifugal speed limiter actuates through the transmission lever (21) to make the pawl (15) and ratchet engage to brake, thereby to increase the total frictional force of the traction wire rope (10) to suspend and to stop the cage (12).

2. Said antislip traction machine according to claim 1, characterized in that the driving pulley (14A) has thereon an internal gear ring (27) for transmitting power in engagement with a gear on an output shaft of the speed reducer.

3. Said antislip traction machine according to claim 1, characterized in that said centrifugal speed limiter (18) is driven through the engagement of a gear (19) on its centrifugal speed limiter shaft tip with a gear (20) provided on the driven pulley.

4. Said antislip traction machine according to claim 1, characterized in that on the driving pulley (14A), driven pulley (14B) is each provided a gear (20), in addition, the antislip traction machine has further two small electric generators (24), two gears (25) on shaft tip thereof are in engagement respectively with gears (20) on the driving pulley and the driven pulley, said small electric generators (24) are connected to an electromagnetic mechanism being able to cut off power supply.

5. Said antislip traction machine according to claim 1, characterized in that a mechanical speed differentiating memanism is provided further to cut off power supply and stop the machine to prevent the driving pulley (14A) from wear of traction rope by idling, the two input shafts of said mechanism are interlocked respectively with the driving pulley (14A), the driven pulley (14B), its two output shafts are interlocked with a centrifugal actuating mechanism.

* * * * *